US006464574B1

(12) United States Patent
Halley

(10) Patent No.: US 6,464,574 B1
(45) Date of Patent: Oct. 15, 2002

(54) PAD QUICK RELEASE DEVICE FOR CHEMICAL MECHANICAL PLANARIZATION

(75) Inventor: David G. Halley, Los Osos, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 09/693,040

(22) Filed: Oct. 20, 2000

Related U.S. Application Data

(60) Provisional application No. 60/162,280, filed on Oct. 28, 1999.

(51) Int. Cl.[7] ..... B24D 17/00

(52) U.S. Cl. ..... 451/490; 451/41; 451/285; 451/287

(58) Field of Search ..... 451/490, 494, 451/491, 41, 285, 287

(56) References Cited

U.S. PATENT DOCUMENTS

| | | | | |
|---|---|---|---|---|
| 3,522,681 | * | 8/1970 | Lampert | 451/490 |
| 3,864,884 | * | 2/1975 | Weissman | 451/490 |
| 4,138,804 | * | 2/1979 | Thielen | 451/490 |
| 5,664,987 | | 9/1997 | Renteln | 451/21 |
| 5,792,709 | * | 8/1998 | Robinson et al. | 438/692 |
| 5,938,504 | | 8/1999 | Talieh | 451/11 |
| 6,022,807 | | 2/2000 | Lindsey, Jr. et al. | 438/693 |
| 6,062,959 | * | 5/2000 | Weldon et al. | 451/307 |
| 6,244,941 | * | 6/2001 | Bowman et al. | 451/287 |
| 6,299,506 | * | 10/2001 | Nishimura et al. | 451/8 |
| 2001/0041650 | * | 11/2001 | Senga et al. | 481/1 |

* cited by examiner

*Primary Examiner*—Joseph J. Hail, III
*Assistant Examiner*—Hadi Shakeri
(74) *Attorney, Agent, or Firm*—Townsend and Townsend and Crew LLP

(57) ABSTRACT

In a chemical-mechanical planarization apparatus, a pad spindle includes a pad chuck operative for selective attachment and detachment of a polishing pad. The pad chuck includes a plurality of pivoting links which cooperate to provide a clamping action to retain the polishing pad. A detachment station engages the pivoting links to detach the polishing pad.

17 Claims, 6 Drawing Sheets

PAD QUICK RELEASE DEVICE FOR CHEMICAL MECHANICAL PLANARIZATION

This application is based on and claims tbe benefit of U.S. Provisional Patent Application No. 60/162,280, filed Oct. 28, 1999, the entire disclosure of which is incorporated herein by reference.

BACKGROUND OF THE INVENTION

The present invention relates to the manufacture of objects. More particularly, the invention provides a technique including a device for planarizing a film of material of an article such as a semiconductor wafer. However, it will be recognized that the invention has a wider range of applicability; it can also be applied to flat panel displays, hard disks, raw wafers, and other objects that require a high degree of planarity.

The fabrication of integrated circuit devices often begins by producing semiconductor wafers cut from an ingot of single crystal silicon which is formed by pulling a seed from a silicon melt rotating in a crucible. The ingot is then sliced into individual wafers using a diamond cutting blade. Following the cutting operation, at least one surface (process surface) of the wafer is polished to a relatively flat, scratch-free surface. The polished surface area of the wafer is first subdivided into a plurality of die locations at which integrated circuits (IC) are subsequently formed. A series of wafer masking and processing steps are used to fabricate each IC. Thereafter, the individual dice are cut or scribed from the wafer and individually packaged and tested to complete the device manufacture process.

During IC manufacturing, the various masking and processing steps typically result in the formation of topographical irregularities on the wafer surface. For example, topographical surface irregularities are created after metallization, which includes a sequence of blanketing the wafer surface with a conductive metal layer and then etching away unwanted portions of the blanket metal layer to form a metallization interconnect pattern on each IC. This problem is exacerbated by the use of multilevel interconnects.

A common surface irregularity in a semiconductor wafer is known as a step. A step is the resulting height differential between the metal interconnect and the wafer surface where the metal has been removed. A typical VLSI chip on which a first metallization layer has been defined may contain several million steps, and the whole wafer may contain several hundred ICs.

Consequently, maintaining wafer surface planarity during fabrication is important. Photolithographic processes are typically pushed close to the limit of resolution in order to create maximum circuit density. Typical device geometries call for line widths on the order of 0.5 $\mu$M. Since these geometries are photolithographically produced, it is important that the wafer surface be highly planar in order to accurately focus the illumination radiation at a single plane of focus to achieve precise imaging over the entire surface of the wafer. A wafer surface that is not sufficiently planar, will result in structures that are poorly defined, with the circuits either being nonfunctional or, at best, exhibiting less than optimum performance. To alleviate these problems, the wafer is "planarized" at various points in the process to minimize non-planar topography and its adverse effects. As additional levels are added to multilevel-interconnection schemes and circuit features are scaled to submicron dimensions, the required degree of planarization increases.

As circuit dimensions are reduced, interconnect levels must be globally planarized to produce a reliable, high density device. Planarization can be implemented in either the conductor or the dielectric layers.

In order to achieve the degree of planarity required to produce high density integrated circuits, chemical-mechanical planarization processes ("CMP") are being employed with increasing frequency. A conventional rotational CMP apparatus includes a wafer carrier for holding a semiconductor wafer. A soft, resilient pad is typically placed between the wafer carrier and the wafer, and the wafer is generally held against the resilient pad by a partial vacuum. The wafer carrier is designed to be continuously rotated by a drive motor. In addition, the wafer carrier typically is also designed for transverse movement. The rotational and transverse movement is intended to reduce variability in material removal rates over the surface of the wafer. The apparatus further includes a rotating platen on which is mounted a polishing pad. The platen is relatively large in comparison to the wafer, so that during the CMP process, the wafer may be moved across the surface of the polishing pad by the wafer carrier. A polishing slurry containing chemically-reactive solution, in which are suspended abrasive particles, is deposited through a supply tube onto the surface of the polishing pad.

CMP is advantageous because it can be performed in one step, in contrast to prior planarization techniques which tend to be more complex, involving multiple steps. For example, planarization of CVD interlevel dielectric films can be achieved by a sacrificial layer etchback technique. This involves coating the CVD dielectric with a film which is then rapidly etched back (sacrificed) to expose the topmost portions of the underlying dielectric. The etch chemistry is then changed to provide removal of the sacrificial layer and dielectric at the same rate. This continues until all of the sacrificial layer has been etched away, resulting in a planarized dielectric layer.

Many other limitations, however, exist with CMP. Specifically, CMP often involves a large polishing pad, which uses a large quantity of slurry material. The large polishing pad is often difficult to control and requires expensive and difficult to control slurries. Additionally, the large polishing pad is often difficult to remove and replace. The large pad is also expensive and consumes a large foot print in the fabrication facility. These and other limitations still exist with CMP and the like.

What is needed is an improvement of the CMP technique to improve the degree of global uniformity that can be achieved using CMP.

SUMMARY OF THE INVENTION

In accordance with specific embodiments of the present invention, a chemical-mechanical planarization apparatus comprises a stage assembly for holding an object for chemical-mechanical planarization a pad spindle, a mechanical drive coupled to the spindle to provide rotational movement of the pad spindle about a center axis, and a pad chuck coupled to the other end of the spindle for selective attachment and detachment of a polishing pad. The pad chuck includes a receiving head having a cavity for receiving a polishing pad. The pad chuck further includes a plurality of links, each pivotally coupled to the receiving head so that a first portion of each link extends beyond the outer periphery of the receiving head. A second portion of each link comes into contact with a polishing pad received in the cavity to effectuate a cooperative clamping action to retain the polishing pad within the receiving head and thus attach the polishing pad to the pad chuck. A detachment station having portions which contact the first portions provides a releasing mechanism to detach the polishing pad. In a particular embodiment, the detachment station is an annulus.

A CMP system according to an aspect of the invention comprises a support stage for supporting a substrate to be polished, a polishing assembly having a drive mechanism for providing rotational about a first axis, a pad spindle coupled at a first end to the drive mechanism, and a pad chuck coupled at a second end of the pad spindle, a pad dispenser for providing a plurality of polishing pads; and a pad receptacle for receiving polishing pads from the pad chuck. The pad assembly is operable wherein the pad chuck is aligned with the pad dispenser in a manner to retrieve a polishing pad from the pad dispenser. The pad assembly is further operable wherein the pad chuck is aligned with the receptacle in a manner to release the polishing pad to the pad receptacle.

DESCRIPTION OF THE SPECIFIC EMBODIMENTS

According to specific embodiments of the present invention, a technique including a device for chemical mechanical planarization of objects is provided. In an exemplary embodiment, the invention provides a polishing pad, which is mounted on a cap. The cap is rotatably coupled to a drive head of a polishing apparatus. The apparatus includes a smaller polishing pad, relative to the size of the object being polished.

Figure 1A:
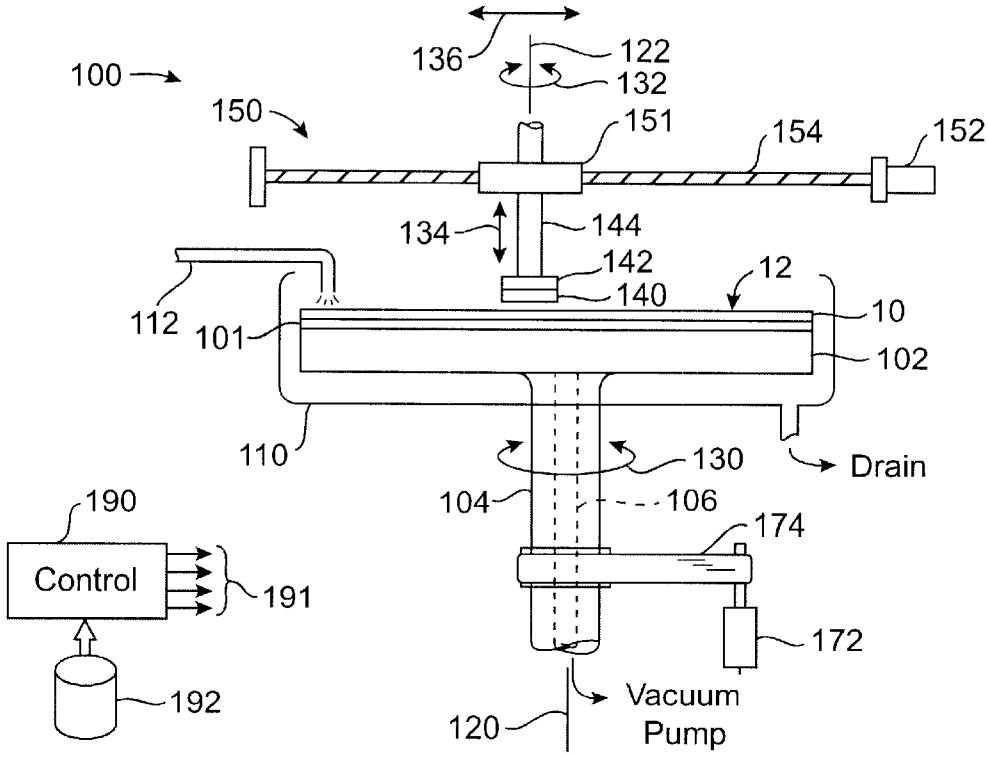
FIG. 1A is a simplified polishing apparatus according to an embodiment of the present invention.

Referring to FIG. 1A, a chemical-mechanical planarization apparatus 100 includes a chuck 102 for holding a wafer 10 in position during a polishing operation. The apparatus shown is merely an example and has been simplified to facilitate a discussion of the salient aspects of the invention. As such, the figure should not unduly limit the scope of the claims herein. One of ordinary skill in the art would recognize many other variations, alternatives, and modifications.

The chuck includes a drive spindle 104 which is coupled to a motor 172 via a drive belt 174 to rotate the wafer about its axis 120. Preferably, the motor is a variable-speed device so that the rotational speed of the wafer can be varied. In addition, the direction of rotation of the motor can be reversed so that the wafer can be spun in either a clockwise direction or a counterclockwise direction. Typically, servo motors are used since their speed can be accurately controlled, as well as their direction of rotation. Alternative drive means include, but are not limited to, direct drive and gear-driven arrangements.

A channel 106 formed through spindle 104 is coupled to a vacuum pump through a vacuum rotary union (not shown). Chuck 102 may be a porous material, open to ambient at its upper surface so that air drawn in from the surface through channel 106 creates a low pressure region near the surface. A wafer placed on the chuck surface is consequently held in place by the resulting vacuum created between the wafer and the chuck. Alternatively, chuck 102 may be a solid material having numerous channels formed through the upper surface, each having a path to channel 106, again with the result that a wafer placed atop the chuck will be held in position by a vacuum. Such vacuum-type chucks are known and any of a variety of designs can be used with the invention. In fact, mechanical clamp chucks can be used. However, these types are less desirable because the delicate surfaces of the wafer to be polished can be easily damaged by the clamping mechanism. In general, any equivalent method for securing the wafer in a stationary position and allowing the wafer to be rotated would be equally effective for practicing the invention.

A wafer backing film 101 is disposed atop the surface of chuck 102. The backing film is a polyurethane material. The material provides compliant support structure which is typically required when polishing a wafer. When a compliant backing is not used, high spots on a wafer prevent the pad from contacting the thinner areas (low spots) of the wafer. The compliant backing material permits the wafer to deflect enough to flatten its face against the polish pad. There can be a deflection of several thousands of an inch deflection under standard polishing forces. Polyurethane is not necessary, however, as any appropriate compliant support material will work equally well. In addition, the wafer typically includes a pressure sensitive adhesive (PSA) film on its bottom surface for coupling with the chuck 102. The PSA film desirably includes a plurality of holes that may be formed by laser to permit application of a vacuum from the chuck 102 on the bottom of the wafer.

FIG. 1A also shows a polishing pad assembly comprising a polishing pad 140, a chuck 142 for securing the pad in position, and a pad spindle 144 coupled to the chuck for rotation of the pad about its axis 122. In the embodiment shown, the pad radius is less than the radius of wafer 10, typically around 20% of the wafer radius. A drive motor (not shown) is coupled to pad spindle 144 to provide rotation of the pad. Preferably, the drive motor is a variable-speed device so that the rotational speed of pad 140 during a particular polishing operation can be controlled. The drive motor preferably is reversible.

Figure 1B:
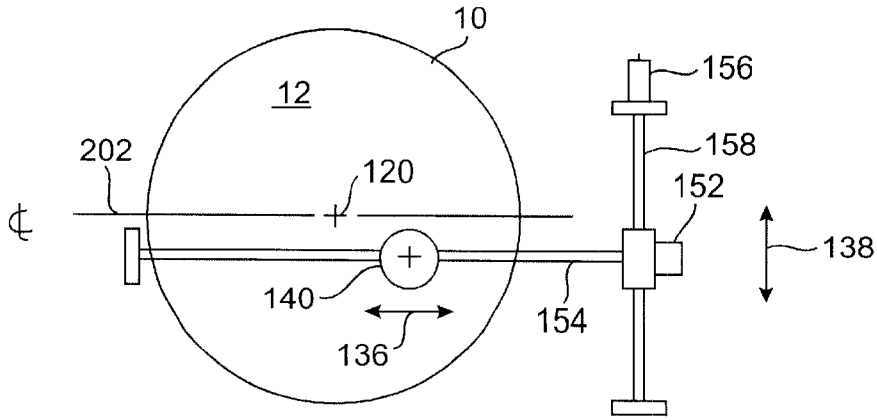
FIG. 1B is an alternative detailed diagram of a polishing apparatus according to an embodiment of the present invention.

Referring to FIGS. 1A and 1B, a traverse mechanism 150 provides translational displacement of the polishing pad assembly across the wafer surface. In one embodiment of the invention, the traverse mechanism is an x-y translation stage that includes a platform 151 for carrying the pad assembly.

The traverse mechanism 150 further includes drive screws 154 and 158, each respectively driven by motors 152 and 156 to move platform 151. Motors 152 and 156 respectively translate platform 151 in the x-direction, indicated by reference numeral 136, and in the y-direction, indicated by reference numeral 138. Motors 152 and 156 preferably are variable-speed devices so that the translation speed can be controlled during polishing. Stepper motors are typically used to provide high accuracy translation and repeatability.

It is noted that the function of traverse mechanism 150 can be provided by other known translation mechanisms as alternatives to the aforementioned x-y translation stage. Alternative mechanisms include pulley-driven devices and pneumatically operated mechanisms. The present invention would be equally effective regardless of the particular mechanical implementation selected for the translation mechanism.

Figure 2:
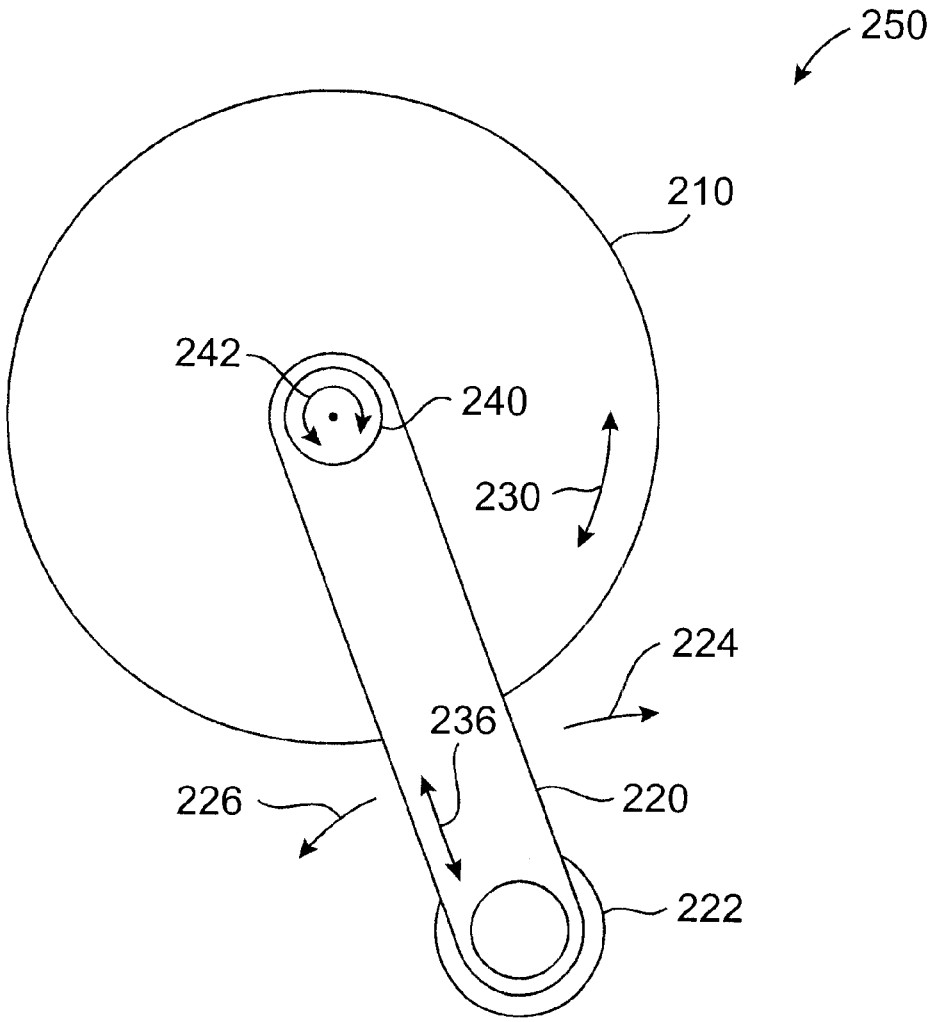
FIG. 2 is a simplified top plan view of a polishing apparatus according to another embodiment of the present invention.

For example, FIG. 2 shows another traverse mechanism 250 which provides angular displacement of the polishing pad assembly across the surface of the wafer 210. A rotational arm 220 is driven by an actuator 222 to rotate the polishing pad 240 coupled to its end, as indicated by arrows 224, 226. The pad 240 spins around its axis as shown by arrows 242. The wafer 210 rotates as shown by arrows 230. These rotations allow the pad 240 to contact and planarize the entire surface of the wafer 210. An optional translation of the arm 220 to move the pad 240 along arrows 236 may be provided.

Continuing with FIG. 1A, the pad 140 is oriented relative to wafer 10 such that process surface 12 of the wafer is substantially horizontal and faces upwardly. The polishing surface of pad 140 is lowered onto process surface 12 of the wafer. This arrangement of wafer surface to pad surface is preferred. If a power failure occurs, the various components in the CMP apparatus will likely cease to operate. In particular, the vacuum system is likely to stop functioning. Consequently, wafer 10 will no longer be held securely in place by vacuum chuck 102. However, since the wafer is already in a neutral position, the wafer will not fall and become damaged when the chuck loses vacuum but will simply rest upon the chuck.

The pad assembly is arranged on the translation stage of traverse mechanism 150 to allow for motion in the vertical direction which is indicated in FIG. 1A by reference numeral 134. This allows for lowering the pad onto the wafer surface for the polishing operation. Preferably, pad pressure is provided by an actuator (e.g., a piston driven mechanism, voice coil, servo motor, lead screw assembly, and the like) having variable-force control in order to control the downward pressure of the pad upon the wafer surface. The actuator is typically equipped with a force transducer to provide a downforce measurement which can be readily converted to a pad pressure reading. Numerous pressure-sensing actuator designs, known in the relevant engineering arts, can be used.

A slurry delivery mechanism 112 is provided to dispense a polishing slurry onto process surface 12 of wafer 10 during a polishing operation. Although FIG. 1A shows a single dispenser 112, additional dispensers may be provided depending on the polishing requirements of the wafer. Polishing slurries are known in the art. For example, typical slurries include a mixture of colloidal silica or dispersed alumina in an alkaline solution such as KOH, $NH_4OH$ or $CeO_2$. Alternatively, slurry-less pad systems can be used.

A splash shield 110 is provided to catch the polishing fluids and to protect the surrounding equipment from the caustic properties of any slurries that might be used during polishing. The shield material can be polypropylene or stainless steel, or some other stable compound that is resistant to the corrosive nature of polishing fluids.

A controller 190 in communication with a data store 192 issues various control signals 191 to the foregoing-described components of polishing apparatus 100. The controller provides the sequencing control and manipulation signals to the mechanics to effectuate a polishing operation. The data store 192 preferably is externally accessible. This permits user-supplied data to be loaded into the data store to provide polishing apparatus 100 with the parameters for performing a polishing operation. This aspect of the preferred embodiment will be further discussed below.

Any of a variety of controller configurations are contemplated for the present invention. The particular configuration will depend on considerations such as throughput requirements, available footprint for the apparatus, system features other than those specific to the invention, implementation costs, and the like. In one embodiment, controller 190 is a personal computer loaded with control software. The personal computer includes various interface circuits to each component of polishing apparatus 100. The control software communicates with these components via the interface circuits to control apparatus 100 during a polishing operation. In this embodiment, data store 192 can be an internal hard drive containing desired polishing parameters. User-supplied parameters can be keyed in manually via a keyboard (not shown). Alternatively, data store 192 is a floppy drive in which case the parameters can be determined elsewhere, stored on a floppy disk, and carried over to the personal computer. In yet another alternative, data store 192 is a remote disk server accessed over a local area network. In still yet another alternative, the data store is a remote computer accessed over the Internet; for example, by way of the world wide web, via an FTP (file transfer protocol) site, and so on.

In another embodiment, controller 190 includes one or more microcontrollers which cooperate to perform a polishing sequence in accordance with the invention. Data store 192 serves as a source of externally-provided data to the microcontrollers so they can perform the polish in accordance with user-supplied polishing parameters. It should be apparent that numerous configurations for providing user-supplied polishing parameters are possible. Similarly, it should be clear that numerous approaches for controlling the constituent components of the CMP are possible.

Figure 3:
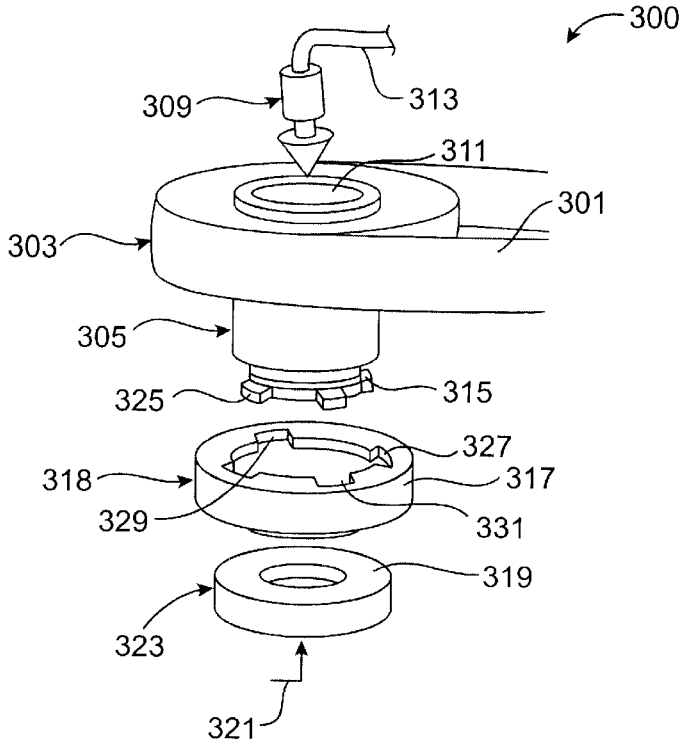
FIG. 3 is a simplified diagram of a drive and cap assembly according to an embodiment of the present invention.

FIG. 3 is a simplified diagram of a drive and cap assembly on a polishing head 300 according to an embodiment of the present invention. The assembly is merely an example and has been simplified to facilitate a discussion of the salient aspects of the invention. As such, the figure should not unduly limit the scope of the claims herein. One of ordinary skill in the art would recognize many other variations, alternatives, and modifications. As shown, the polishing head 300 includes a variety of features such as a drive belt 301 and a support structure which couples to a support. Additionally, the polishing head includes a drive device 303, which couples to a drive shaft 305. The drive shaft has a first end, which is attached to the drive device, and a second end, which includes a coupling 315. The coupling mates to a removable cap 317, which includes an outer region 318. The removable cap rotatably attaches to the coupling in a secure manner. Although the present cap is rotatable, there can be other ways of attaching the cap to the coupling. The rotatable cap also has a polishing pad 323, which can be fixed to the cap before it is secured to the coupling. The polishing pad may have an opening 321, but can also be one continuous member. The top surface 319 of the pad contacts the cap to secure it in place.

Now, to secure the removable cap onto the coupling, the cap is brought into contact and is aligned to the coupling. Here, each of the threads 325 is aligned with a respective thread opening 327, inserted along a first direction toward the support structure, until each thread bottoms against a stop 329 in the opening. Next, the cap is rotated in a counter clockwise manner, where the groove 331 guides each thread such that the cap biases against the coupling to secure it in place. Once the cap is secured, the drive shaft 305 rotates the pad in a counter clockwise circular manner during a process operation. By way of the counter clockwise manner, the cap does not loosen up and continues to be biased against the coupling. In other embodiments, the rotatable cap and coupling are mated to each other in a clockwise manner, where the drive rotates the pad in a clockwise manner.

To remove the cap from the coupling, the drive is secured in place manually or by a brake, where the rotatable coupling cannot be rotated through the drive. The cap is grasped and turned in a clockwise manner, which guides each thread away from the bias to release the cap from the coupling. Once each thread is aligned with its opening, the cap is dropped to free it from the coupling. Again, in other embodiments, the rotatable cap and coupling have been mated to each other in a clockwise manner, where the drive rotates the pad in a clockwise manner. In a preferred embodiment, the present cap is removed from the coupling by way of the technique illustrated by FIG. 4 below. This technique provides an automatic or "hands free" approach to removing the cap from the coupling.

The present cap, which is rotatably attached, can be replaced by other types of coupling devices. Of course, the type of coupling device used depends upon the application.

The polishing head also includes a sensing device 309, which is coupled to a processing unit, such as the one noted but can be others. The sensing device can look through an inner opening 311 of the drive shaft 305 to the polishing pad. In some embodiments, the polishing pad is annular in structure with an opening 321 in the center. The opening allows the sensor to sense a fluid level or slurry level at the workpiece surface, which is exposed through the center opening in the pad. Of course, the type of coupling device used depends upon the application.

Figure 3A:
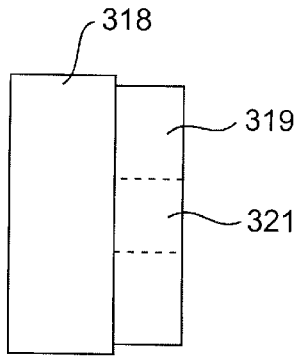
FIG. 3A is a simplified diagram of a combined cap and pad assembly according to an embodiment of the present invention.

FIG. 3A is a simplified diagram of a combined cap and pad assembly according to an embodiment of the present invention. This diagram is merely an illustration, which should not limit the scope of the claims herein. One of ordinary skill in the art would recognize many other variations, modifications, and alternatives. In a specific embodiment, the removable cap and polishing pad are in an assembly. The assembly is provided to the manufacturer of integrated circuits, for example, for use with the present polishing apparatus. The assembly can be pre-packaged in a clean room pack. The assembly can include the cap 318 and the pad 323, which may include an inner orifice or opening 321. Depending upon the embodiment, the pad can be one of a variety according to the present invention.

The cap can be made of a suitable material to withstand both chemical and physical conditions. Here, the cap can be made of a suitable material. The cap is also preferably transparent, which allows the sensing device to pick up optical signals from the workpiece surface. The cap is also sufficiently rigid to withstand torque from the drive shaft. The cap can also withstand exposure to acids, bases, water, and other types of chemicals, depending upon the embodiment. The cap also has a resilient outer surface to prevent it from damage from slurries, abrasive, and other physical materials. Further details of removing the cap are provided below.

Figure 4:
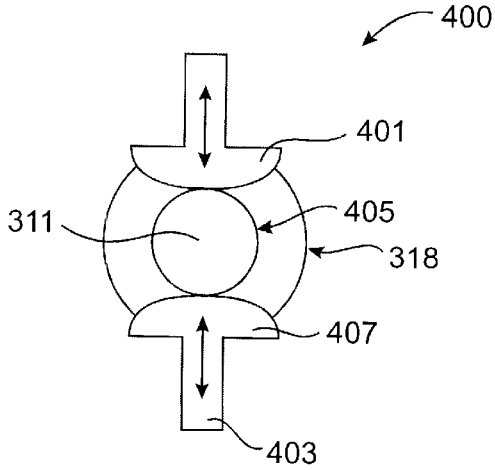
FIG. 4 is a simplified diagram of a polishing pad according to an embodiment of the present invention.

FIG. 4 is a simplified diagram of a polishing pad device 400 according to an embodiment of the present invention. The device is merely an example and has been simplified to facilitate a discussion of the salient aspects of the invention. As such, the figure should not unduly limit the scope of the claims herein. One of ordinary skill in the art would recognize many other variations, alternatives, and modifications. In a preferred embodiment to remove the cap, the cap 317 is placed between two handling arms 401, 403. Each of the arms places a lateral force against the cap to hold it in place. The motor drives the drive shaft in a clockwise (or counter clockwise) manner to release the threads of the cap from the coupling. Once the threads have been released the drive shaft is lifted to free the cap from the coupling.

Next, the removed cap is placed into a disposal. Here, the handling arms can move the cap from a removal location to a disposal location.

Figure 5A:
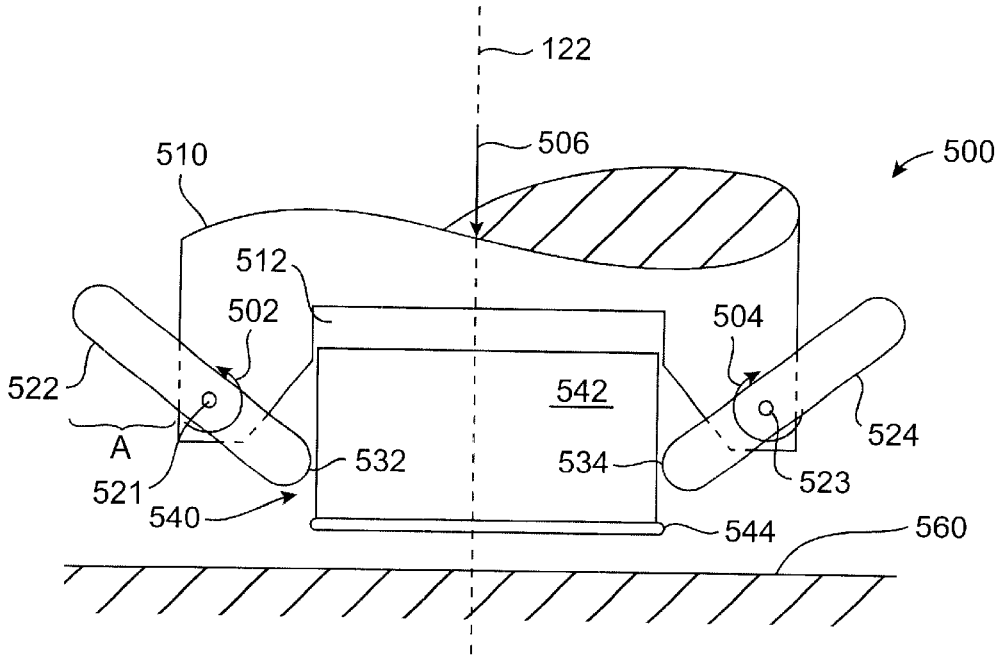
FIGS. 5A and 5B are simplified illustrations of an alternate embodiment of the polishing apparatus of the present invention.
Figure 5B:
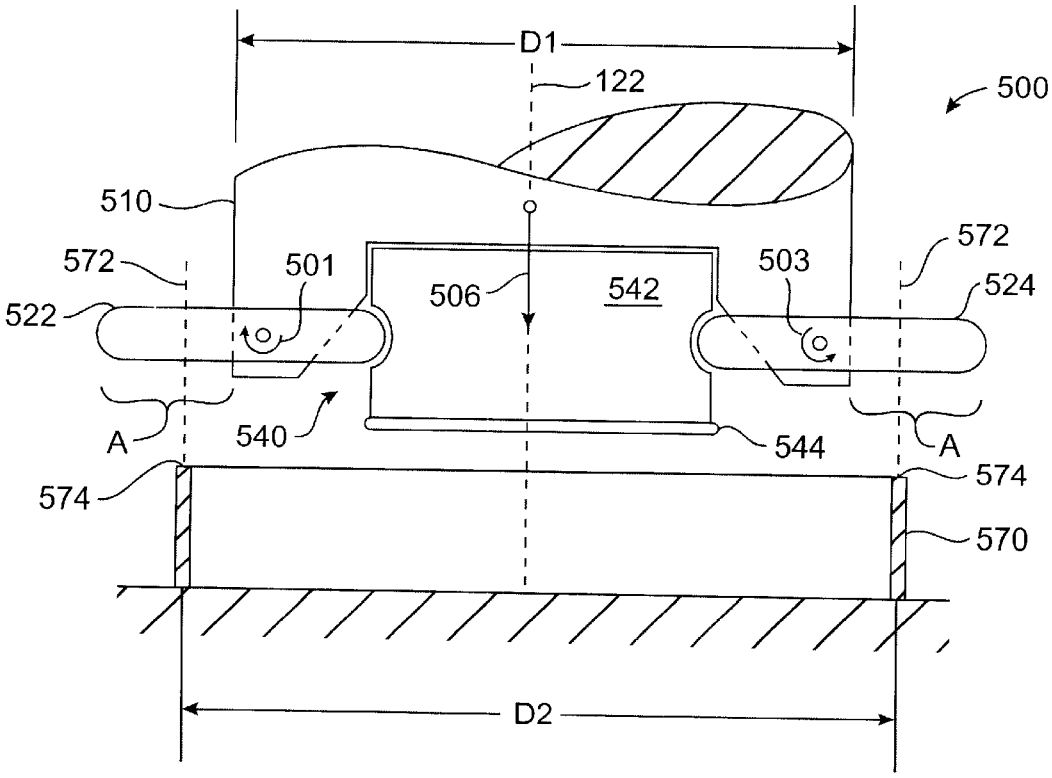

FIGS. 5A and 5B are simplified diagrams of an alternate embodiment of the polishing pad assembly shown in FIG. 1A. This diagram is merely an illustration, which should not limit the scope of the claims herein. One of ordinary skill in the art would recognize many other variations, modifications, and alternatives. FIG. 5A shows a chuck assembly 500 comprising a receiving head 510. The receiving head includes a cavity 512 and a plurality of links 522, 524. Each link 522, 524 is pivotally attached to receiving head 510 about a pivot point 521, 523 respectively. Each link has a first portion A which extends beyond the outer perimeter of receiving head 510. As will be discussed below, there is a second portion B which extends into cavity 512 when the links are in a locked position.

Figure 6:
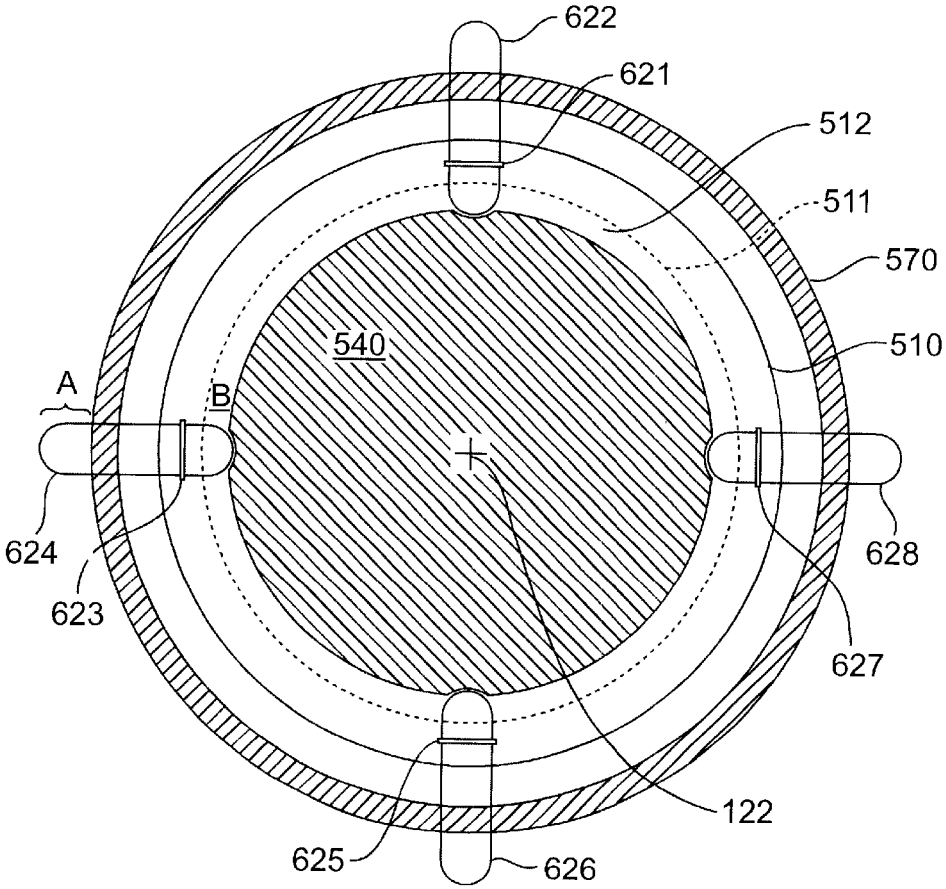
FIG. 6 shows a top view of embodiments shown in FIGS. 5A and 5B.

The opening of cavity 512 is shaped to receive a polishing pad 540. Typically, the opening of cavity 512 is circular, since commercially available polishing pads generally are round. The view of FIG. 5A shows two links 522, 524. However, it is understood that additional links can be provided. Preferably, the links are arranged about the opening of cavity 512 with equal spacing. For example, the overhead view of FIG. 6 shows four such links 622, 624, 626, and 628 equally spaced about pas axis 122. FIG. 5A shows the links in a released position, wherein contacting portions 532, 534 of the links have a circumferential measure that is greater than that of polishing pad 540.

FIG. 5A also shows a simplified representation of a typical polishing pad. As can be seen pad 540 usually comprises a "puck" 542 to which a polishing component 544 is attached. The polishing component comprises known materials having suitable abrasive properties for a polishing operation. As can be seen, polishing pad 540 is attached to pad chuck 500 by a downward motion 506 of the chuck. Since the links have a circumferential measure that exceeds the pad when in the released position, the pad can begin to be received in cavity 512. As the chuck continues its descent, contacting portions 532, 534 of links 522, 524 engage the sides of the puck 542. As the chuck descends further, the links begin to toggle from the released position shown in FIG. 5A to a locked position as shown in FIG. 5B. Thus, the links 'snap' into the locked position by virtue of catching the sides of puck 542. As can be seen in FIG. 6, portions B of the links extend into cavity 512 of the receiving head 510 in the locked position. This allows the links to attain a secure clamping action on the puck. Preferably, puck 542 is of a suitably compliant material so that there is sufficient give when the links extend into the body of the puck during their transition from the released position (FIG. 5A) to the locked position (FIG. 5B).

Referring to FIG. 6, it can be seen that links 622, 624, 626, 628 cooperate to clamp polishing pad 540 securely in position within cavity 512 of the chuck. The number of such links will depend on frictional properties of the material of the puck 542 and any surface characteristics and treatments on the puck, and surface characteristics and treatments of the contacting portions (e.g. 532, 534 of FIG. 5A).

Referring to FIG. 5B, the reverse action of toggling the links from the locked position to the released position is shown. The chuck 500, having an attached polishing pad, is positioned above an annular member 570. The diameter D2 of the annular member is greater than the diameter D1 of the receiving head 510. As can be seen, portions A of the links 522, 524 extend beyond the outer perimeter of the receiving head. Consequently, as receiving head 510 is lowered within the perimeter of annular member 570, portions A will encounter the rim 574 of the annular member. Continued descent of the receiving head will cause the links 522, 524 to rotate in directions 501, 503 respectively. This will effectively toggle the links to the released position shown in FIG. 5A. This results in detachment of the polishing pad from the chuck. Though a annular member is shown, it is clear that alternate configurations for toggling the links to the released position are readily realized.

Figure 7:
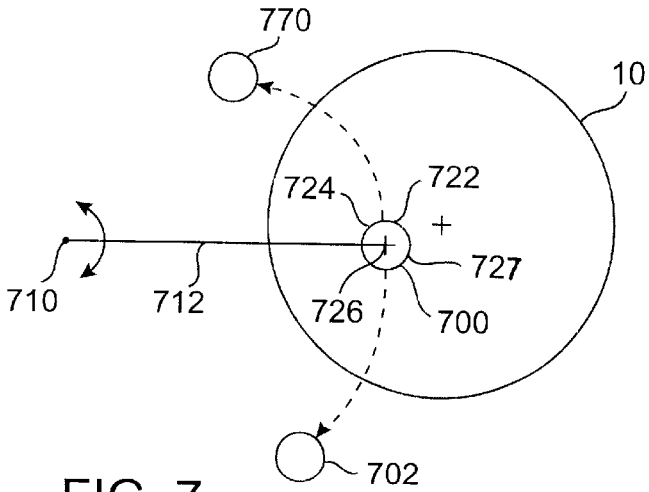
FIG. 7 is a schematic representation of a polishing system employing the alternate embodiment shown in FIGS. 5A and 5B.

FIG. 7 schematically illustrates a CMP system in accordance with this embodiment of the invention. A wafer 10 having a surface to be polished is shown. Polishing pad assembly is shown, comprising a chuck 700 mounted to a rotating arm 712 to provide rotation about axis 710. A magazine station 770 containing a vertical stack of polishing pads is provided. Although one magazine station is shown, typically there will be three such stations one for each grade of abrasive: grinding, polishing, and buffing. A receptacle 702 is provided for receiving spent polishing pads.

In operation, the pad assembly is operated (e.g. by controller 190 in shown in FIG. 1A) to pick up a polishing pad at magazine 770. A first polishing pad is attached to the chuck in the manner as discussed in connection with FIG. 5A. Pads in the magazine are stacked one atop another. The chuck is vertically aligned with the magazine and lowered. The topmost pad becomes attached as shown in FIG. 5A when the receiving head of the chuck is lowered onto the pad.

The pad assembly is then operated to position the attached pad relative to the wafer to begin a polishing operation. When it is determined that the pad needs replacement, the pad assembly positions chuck 700 over receptacle 702. There, the pad is detached from the chuck in the manner discussed in connection with FIG. 5B. The chuck is lowered. Eventually, the receptacle will engage portions A of the links 522, 524 as shown in FIG. 5B. This action will cause the links to toggle to the released position. The attached pad detaches and drops into the receptacle. The chuck is then repositioned to magazine 700 to repeat the cycle.

It can be seen that the chuck device of this embodiment greatly simplifies changing pads during a polishing operation. User intervention is avoided and consequently CMP downtime is minimized.

Figure 8:
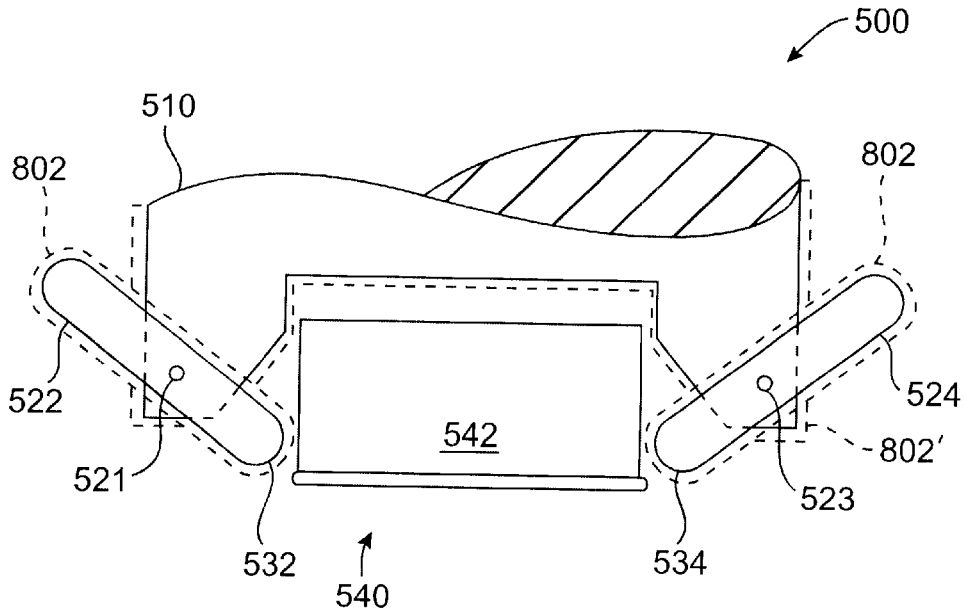
FIGS. 8 and 9 show a variations of the embodiment shown in FIG. 5A.

Referring now to FIG. 8, portions of the receiving head may be provided with a membranous coat 802. For example, a urethane membrane can be provided to encapsulate the links. The membrane may be made of other flexible materials including polymers. This protects the moving parts of the links and pivoting points 521, 523 from the various chemical and particulate contaminants resulting from a polishing operation. Conversely, the membrane prevents particles, which can be produced by the links, from escaping and contaminating the polishing area. Alternatively, the entire receiving head can be encapsulated by a membrane.

Figure 9:
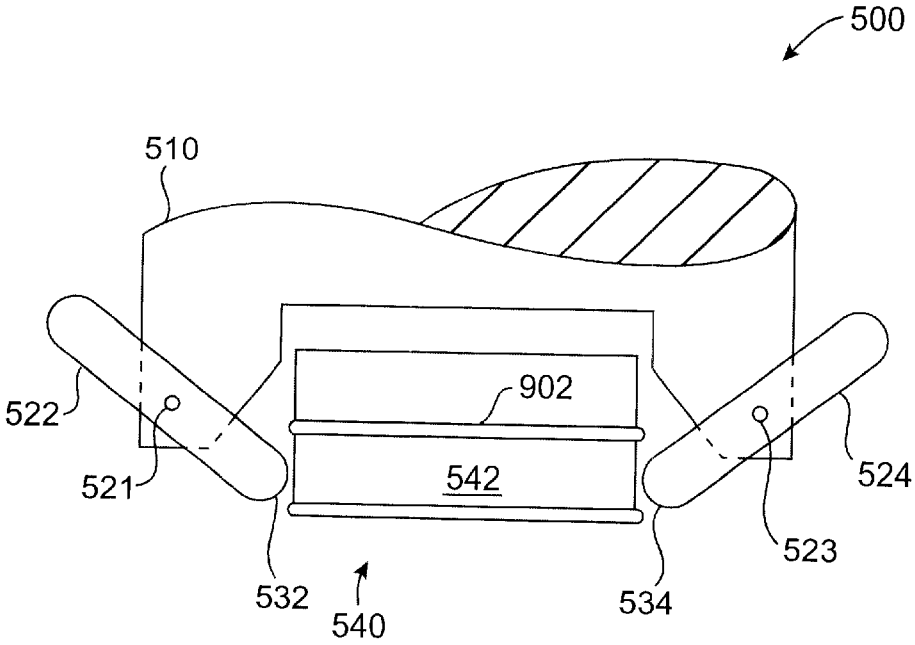

FIG. 9 shows an O-ring 902 disposed about puck 542. It is believed the O-ring provides additional positive gripping action when the links are flipped into the locking position. Of course, other configurations can be used to secure the puck 542 with the links. For example, the O-ring 902 may be replaced by a plurality of discrete projections around the puck 542 for cooperating with the links (e.g., four arc-shaped projections for four links 622–628).

While the above is a full description of the specific embodiments, various modifications, alternative constructions and equivalents known to those of ordinary skill in the relevant arts may be used. For example, while the description above is in terms of a semiconductor wafer, it would be possible to implement the present invention with almost any type of article having a surface or the like. Therefore, the above description and illustrations should not be taken as limiting the scope of the present invention which is defined by the appended claims.

What is claimed is:

1. A chemical-mechanical planarization apparatus comprising:

a stage assembly for holding an object for chemical-mechanical planarization;

a pad spindle having a first end and a second end;

a mechanical drive coupled to said first end to provide rotational movement of said pad spindle about a center axis; and a pad chuck disposed at said second end, effective for selective attachment and detachment of a polishing pad;

said pad chuck including a receiving head, said receiving head having a cavity and an outer periphery;

said pad chuck further including a plurality of links, each link having a first portion and a second portion;

each link pivotally coupled to said receiving head so that said first portion extends beyond the outer periphery of said receiving head;

said links having a locking position wherein said second portions are in contact with a polishing pad received in said cavity to effectuate a cooperative clamping action to retain said polishing pad within said receiving head and thus attach said polishing pad to said pad chuck.

2. The apparatus of claim 1 wherein each of said second portions has a pad contacting end for contacting said polishing pad, said pad contacting ends defining a first circumference when said links are in said locking position; said first circumference being smaller than the circumference of said polishing pad thereby providing said clamping action.

3. The apparatus of claim 1 wherein said links have a released position effective to position said second portions out of contact of said polishing pad; the apparatus further including a detachment station; said detachment station having spaced portions which contact said first portions in a manner as to pivot said links into said released position.

4. The apparatus of claim 3 wherein pivoting said links from said locking position to said released position effectuates ejection of said polishing pad from said receiving head.

5. The apparatus of claim 3 wherein said detachment station is an annulus having a diameter sufficient to encircle said receiving head and to contact said first portions of said links.

6. The apparatus of claim 1 wherein said links have a released position effective to position said second portions in a manner to pivot relative to said receiving head and engage sides of said polishing pad, whereby a downward motion of said pad chuck upon said polishing pad with said links engaging said sides of said polishing pad pivots said links into said locking position.

7. The apparatus of claim 1 further including a membrane which encapsulates said links.

8. The apparatus of claim 7 wherein said membrane comprises a flexible polymer material.

9. The apparatus of claim 1 further including a membrane encapsulating said receiving head and said links.

10. A chemical-mechanical planarization apparatus comprising:

a stage assembly for holding an object for chemical-mechanical planarization;

a pad spindle having a first end and a second end;

a mechanical drive coupled to said first end to provide rotational movement of said pad spindle about a center axis; and a pad chuck disposed at said second end, effective for selective attachment and detachment of a polishing pad;

said pad chuck including a receiving head, said receiving head having a cavity and an outer periphery;

said pad chuck further including a plurality of links, each link having a first portion and a second portion;

each link pivotally coupled to said receiving head so that said first portion extends beyond the outer periphery of said receiving head;

said links having a locking position wherein said second portions are in contact with a polishing pad received in said cavity, thereby effectuating a cooperative clamping action of said polishing pad for attachment to said pad chuck;

said links having a released position wherein said second portions are out of contact with said polishing pad to detach said polishing pad from said pad chuck.

11. The apparatus of claim 10 wherein said second portions include pad contacting ends having predetermined shapes, said pad contacting ends effective for engaging portions of said polishing pad having complementary shapes for engagement with said pad contacting ends.

12. The apparatus of claim 10 wherein said links are encapsulated in a membrane effective for protection against contaminants.

13. The apparatus of claim 12 wherein said membrane comprises urethane.

14. The apparatus of claim 10 wherein said receiving head and said links are encapsulated in a membrane effective for protection against contaminants.

15. A CMP system comprising:

a support stage for supporting a substrate to be polished;

a polishing assembly having a drive mechanism for providing rotational movement about a first axis, a pad spindle coupled at a first end to said drive mechanism, and a pad chuck coupled at a second end of said pad spindle;

a pad dispenser for providing a plurality of polishing pads; and a pad receptacle for receiving polishing pads from said pad chuck;

said polishing assembly having a loading position wherein said pad chuck is aligned with said pad dispenser in a manner to retrieve a polishing pad from said pad dispenser;

said polishing assembly having an off-loading position wherein said pad chuck is aligned with said receptacle in a manner to release said polishing pad to said pad receptacle, wherein said pad chuck includes:

a receiving head, said receiving head having a cavity and an outer periphery; and a plurality of links, each link having a first portion and a second portion;

each link pivotally coupled to said receiving head so that said first portion extends beyond the outer periphery of said receiving head;

said links having a locking position wherein said second portions are in contact with a polishing pad received in said cavity, thereby effectuating a cooperative clamping action of said polishing pad for attachment to said pad chuck;

said links having a released position wherein said second portions are out of contact with said polishing pad to detach said polishing pad from said pad chuck.

16. The system of claim 15 wherein said pad receptacle includes portions which engage said links in a manner to position said link in said released position.

17. The system of claim 16 wherein said magazine includes a plurality of vertically stacked polishing pads.

* * * * *